United States Patent [19]

Burenga

[11] 4,077,747

[45] Mar. 7, 1978

[54] PORTABLE AIR COMPRESSOR

[75] Inventor: Thomas I. Burenga, Richland Center, Wis.

[73] Assignee: TSC Industries, Inc., Chicago, Ill.

[21] Appl. No.: 721,041

[22] Filed: Sep. 7, 1976

[51] Int. Cl.[2] ..... F04B 21/00

[52] U.S. Cl. ..... 417/234

[58] Field of Search ..... 417/234, 313, 63, 231, 417/235; 280/5 R; 180/89.17; 222/164

[56] References Cited

U.S. PATENT DOCUMENTS

| | | | |
|---|---|---|---|
| 1,072,943 | 9/1913 | Hall | 417/235 X |
| 2,490,305 | 12/1949 | Jones | 280/5 R |
| 2,804,259 | 8/1957 | Ralston | 417/234 X |
| 3,157,240 | 11/1964 | Chew | 180/89.17 X |

FOREIGN PATENT DOCUMENTS

| | | | |
|---|---|---|---|
| 1,010,710 | 3/1952 | France | 180/89.17 |

*Primary Examiner*—Carlton R. Croyle
*Assistant Examiner*—R. E. Gluck
*Attorney, Agent, or Firm*—Kinzer, Plyer, Dorn & McEachran

[57] ABSTRACT

A portable air compressor comprising a pump and pump drive unit mounted on a wheel-supported base and totally enclosed within a sheet metal shroud that also serves as a support for a storage tank; the shroud is pivotally mounted on the base for movement to an open position in which the pump and drive unit are fully exposed for inspection and maintenance.

6 Claims, 4 Drawing Figures

Fig. 1.
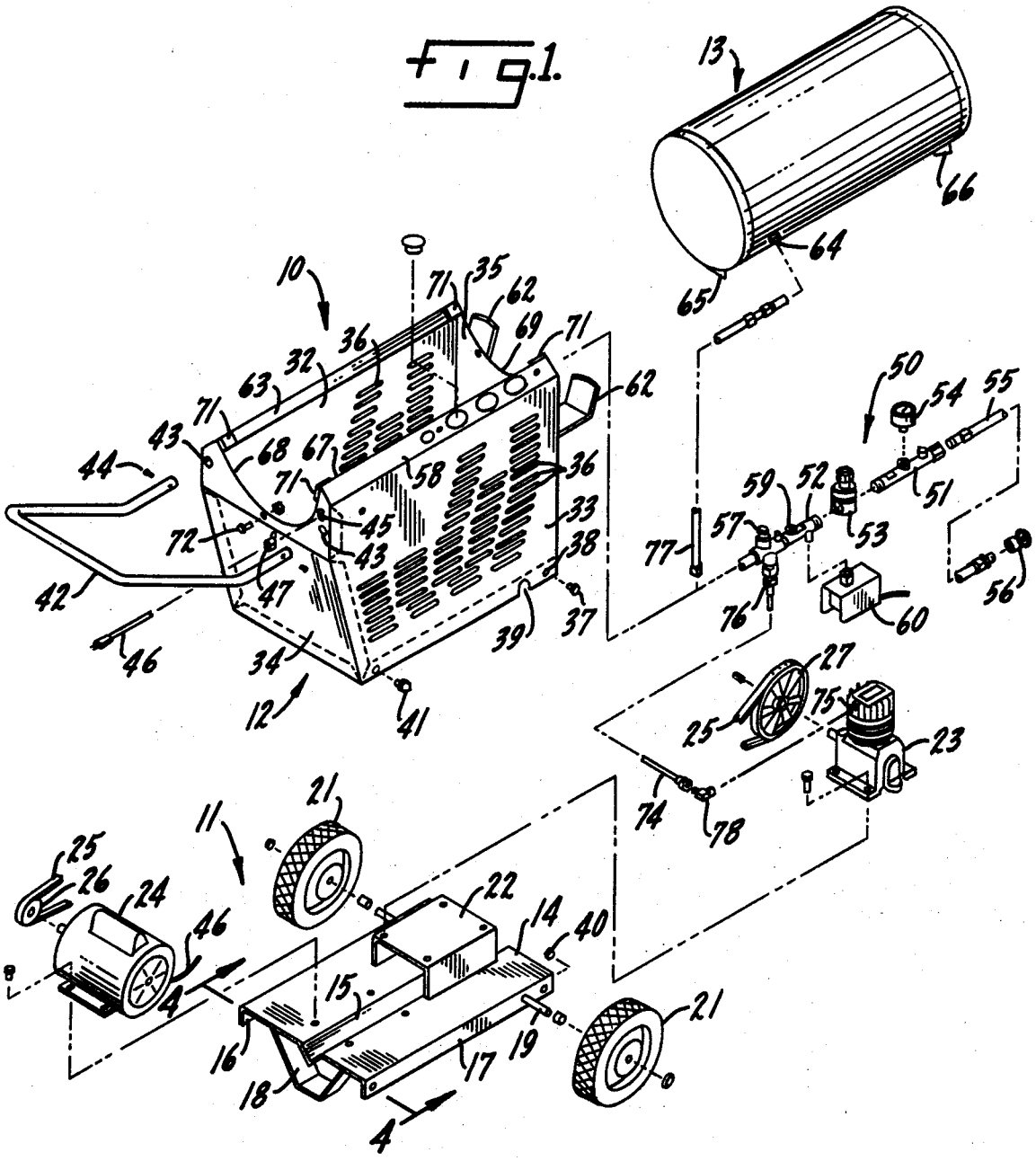
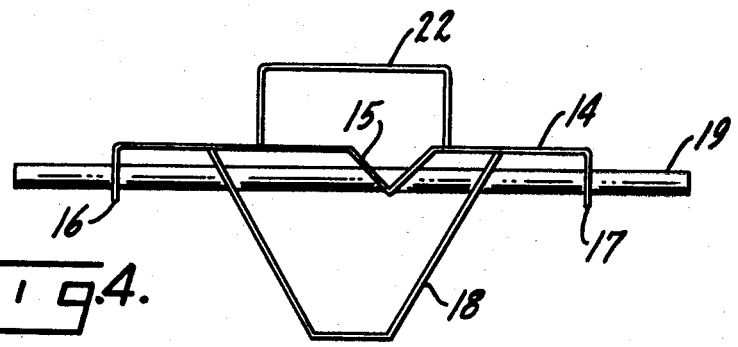
Fig. 4.

PORTABLE AIR COMPRESSOR

BACKGROUND OF THE INVENTION

A portable air compressor, highly useful in both industrial and agricultural applications, usually comprises a compressor pump, a drive unit for the pump, and a storage tank. Most frequently, the tank is mounted upon wheels to provide portability, with the compressor pump and its drive unit mounted above the tank on a frame affixed to the tank. The compressor is usually equipped with a pressure gauge, a pressure regulator, a relief valve, control switches, and other necessary fittings.

In the conventional construction, with the compressor pump and drive unit mounted on top of the storage tank, there is excellent accessibility to the pump and drive unit for service and maintenance purposes. However, this construction is inherently top-heavy and unstable because the pump and drive unit are substantially heavier than the tank, leaving much to be desired from the standpoint of occupational safety. On the other hand, it has been known to mount the tank on a frame with the pump and its drive unit supported within the frame below the tank. This inverted construction greatly improves the stability of the portable air compressor, placing its center of gravity at a safe low level. However, accessibility of the compressor pump and the drive unit for service and maintenance purposes is materially hampered by the tank. Furthermore, it is quite desirable to enclose the pump and drive unit for occupational safety; any such enclosure further reduces accessibility so that service becomes inconvenient and time-consuming.

In portable air compressors having the tank mounted above the pump, a sturdy support frame has been considered necessary. Usually, the frame is formed of steel angle members or steel tubes, capable of supporting all of the compressor components and also adapted to withstand the heavy vibration produced by compressor operation. A frame of this kind is relatively expensive and adds materially to the overall cost of the air compressor, as compared with a sheet metal construction. However, it has not heretofore been considered that a sheet metal housing affords adequate rigidity and strength under the severe vibration conditions encountered in the operation of an air compressor.

SUMMARY OF THE INVENTION

It is a principal object of the present invention, therefore, to provide a new and improved construction for a portable air compressor that effectively and inherently eliminates or minimizes the problems and difficulties of previously known devices, as discussed above.

A further object of the invention is to provide a new and improved portable air compressor construction in which the compressor pump and drive unit are mounted below the storage tank to afford a low center of gravity, and the entire operating mechanism is totally enclosed, but convenient and rapid service accessibility is provided.

Another object of the invention is to provide a new and improved base construction, for a portable air compressor of the kind comprising a compressor pump and pump drive mounted below a storage tank, that permits the use of ordinary sheet metal construction for the base.

An additional object of the invention is to provide a new and improved portable air compressor affording maximum operational safety and full service accessibility in a sheet metal structure that is simple and economical and that provides maximum service life.

Accordingly, the invention relates to a portable air compressor comprising a base assembly including a base, a pump and a pump drive unit mounted on the base, a pair of wheels supporting one end of the base, and a stand supporting the other end of the base. The compressor further comprises a shroud assembly, including a four-panel shroud open at the top and at the bottom, pivotally mounted on one end of the base assembly for movement between a normal position, in which the shroud encloses the pump and the pump drive unit, and an open position, in which the pump and pump drive unit are exposed for service. A tank is mounted on and closes the top of the shroud; air conduit means connects the outlet of the pump to the tank and maintains that connection for all positions of the shroud.

BRIEF DESCRIPTION OF THE DRAWINGS

FIG. 1 is an exploded view of a portable air compressor constructed in accordance with a preferred embodiment of the present invention;

FIG. 4 is a detail cross sectional view of the support base for the compressor pump and drive, taken approximately as indicated by line 4—4 in FIG. 1.

DESCRIPTION OF THE PREFERRED EMBODIMENT

Figure 2:
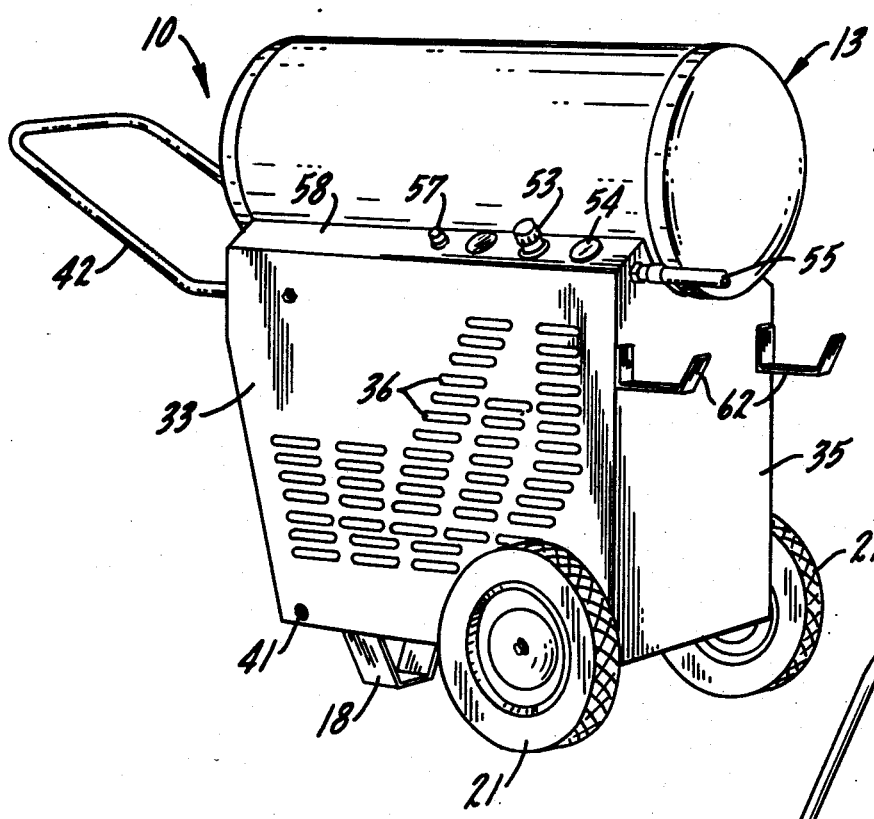
FIG. 2 is a perspective view, taken from one side, illustrating the air compressor of FIG. 1 in its normal operating condition with the compressor pump and drive unit totally enclosed by a safety shroud.
Figure 3:
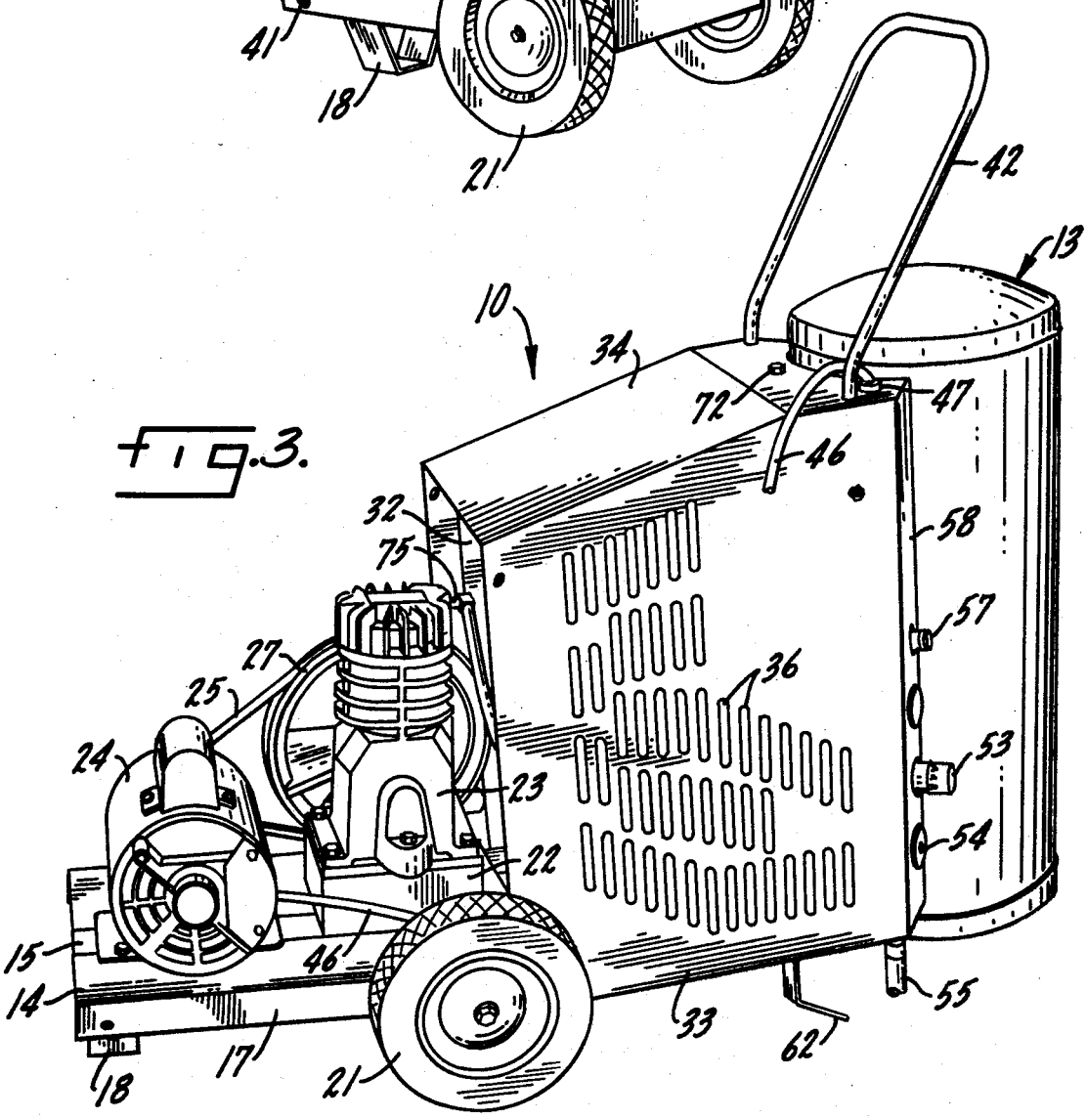
FIG. 3 is a perspective view, taken from the same side as FIG. 2, showing the air compressor in an open condition with the compressor pump and drive unit fully exposed for service or maintenance.

FIGS. 1–3 illustrate a portable air compressor 10 constructed in accordance with a preferred embodiment of the present invention. Compressor 10 includes three basic units, comprising a base assembly 11, a shroud assembly 12, and a storage tank 13.

The base assembly 11 includes a sheet metal base 14 formed with a V-shaped reinforcement depression 15 extending longitudinally for the length of the base (FIGS. 1 and 4). The sides of base 14 are bent downwardly at an angle of approximately 90° to form two longitudinal mounting flanges 16 and 17. A sheet metal stand 18 of truncated V shaped configuration is welded to the bottom of base 14 at one end of the base. At the opposite end of the base, an axle 19 extends transversely of the base between the two flanges 16 and 17. Two wheels 21 are journalled on axle 19 so that wheels 21 and stand 14 afford a stable support for base 14.

A sheet metal saddle 22 is welded to one end of base 14 to afford a support for a compressor pump 23. A drive unit for pump 23, in this instance comprising an electric motor 24, is mounted on the other end of base 14. A drive connection from drive unit 24 to compressor pump 23 is afforded by a V-belt 25, which engages a pulley 26 mounted on the shaft of motor 24 and a pulley-fan 27 mounted on the shaft of compressor pump 23.

Although an electric motor, such as motor 24, is the most commonly used form of drive unit for portable air compressors, such as compressor 10, this is not the only suitable kind of drive unit. Thus, the electric motor 24 may be replaced by a small internal combustion engine for applications in which an electrical power supply is not readily available. For some agricultural uses, the drive unit for compressor pump 23 may comprise a drive shaft fitting permitting connection of the compressor pump to the power take-off of a tractor or other farm machine. Any reference to a pump drive unit in this specification should be interpreted to include any of these various drive arrangements.

The shroud assembly 12 for compressor 10 comprises two side panels 32 and 33 and two end panels 34 and 35 affording a four-sided shroud that is open at the top and at the bottom. Each of the panels 32–35 is preferably formed of sheet metal. The four panels 32–35 could be secured together by bolts or other similar fastening means, but are preferably spot-welded to each other to afford a unitary, relatively rigid shroud structure. Each of the two side panels 32 and 33 is provided with a multiplicity of ventilation openings 36 for cooling pump 23.

The shroud 32–35 is pivotally mounted on one end of base assembly 11. In the illustrated construction, this pivotal mounting is accomplished in part by a pivot member 37, which may be an ordinary cap screw, that is mounted on flange 17 of base 14 and extends through a slightly oversize opening 38 in the lower edge portion of panel 33, engaging a lock nut 40. A similar construction (not shown) at the opposite side of the compressor completes the pivotal mounting of the shroud on the base. A slot 39 in the bottom edge of each of the side panels provides clearance for axle 19. The pivotal mounting arrangement for shroud assembly 12 is such that the shroud can be moved between a normal position, in which the shroud encloses the compressor pump 23 and its drive unit 24 for safety while the compressor is in operation (FIG. 2), and an open position in which pump 23 and drive unit 24 are fully exposed for service or maintenance (FIG. 3).

Two releasable retainers 41 are provided for anchoring the end of the shroud opposite the pivot members 37 to the base 14 when the shroud is in its normal position (see FIGS. 1 and 2; only one fastener is shown). Retainers 41 may be of any desired construction, and may comprise ordinary screws.

A tubular metal handle 42 is mounted upon the upper end of shroud assembly 12 at the far end of the shroud from the pivotal mounting afforded by the members 37. Handle 42 is used to wheel the air compressor around when shroud assembly 12 is in its normal closed position (FIG. 2). Handle 42 also provides a convenient means for opening the shroud to the position (FIG. 3) when necessary for service or maintenance purposes. The ends of handle 42 extend through two openings 43 in end panel 34, and the handle is secured to the shroud by suitable fasteners 44, which may be ordinary self-tapping screws. Another opening 45 in end panel 34 provides access for a power cord 46 for the pump drive motor 44, the power cord being provided with a suitable stress relief connector 47.

Shroud assembly 12 further comprises a control manifold 50 which includes a right-hand (output) manifold conduit 51 joined to a left-hand (input) manifold conduit 52 through a pressure regulator 53. A line pressure gauge 54 is connected to the output manifold section 51, at an intermediate point, and the right-hand end of manifold section 51 is connected to an output hose 55 that terminates in a conventional air chuck 56. The left-hand or input manifold section 52 is equipped with a relief valve 57. The entire manifold 50 is mounted underneath a ledge 58 formed integrally with the top edge of shroud panel 33. Relief valve 57, regulator 53, and gauge 54 are exposed through suitable openings in ledge 58. Manifold section 52 may be provided with an additional gauge connection 59 for a tank pressure gauge if desired. A pressure switch 60 is connected to manifold section 52 and is electrically connected (connection not shown) to motor 24.

The connection for output hose 55 is made through a suitable opening in end panel 35 of shroud assembly 12 (see FIG. 2). Two hose brackets 62, formed of relatively heavy gauge sheet metal are welded on the outside of panel 35 and provide for storage of hose 55 when not in use.

Tank 13 is a conventional cylindrical metal storage tank having a bung 64. The length of the tank is preferably approximately equal to the overall length of the top of shroud 12 but can be slightly longer. A sheet metal mounting clip 65 is welded to the bottom left-hand end of tank 13, and two similar clips 66 (only one shown) are welded to the opposite end of the tank.

The upper edge of shroud panel 32 is bent downwardly and inwardly to afford a support ledge 63; a similar ledge construction 67 is provided along the top edge of panel 33. The upper edges of the two end panels 34 and 35 are formed with arcuate indentations 68 and 69 each having a curvature approximately matched to the outer contour of tank 13. A plurality of resilient mounting pads 71 are mounted on the ledges 63 and 67. Thus, the top of shroud 12 affords a cradle for supporting tank 13. When the tank is mounted on the shroud, it completely closes the top of the shroud. Suitable fastening means, such as the cap screw 72, are employed to secure the shroud end panels 34, 35 to the mounting clips 65, 66 on tank 13.

There are two internal air conduits in compressor 10. The first air conduit comprises a flexible hose 74 that connects the outlet 75 of pump 23 to the input section 52 of manifold 50. A compression elbow 78 may be utilized to connect one end of hose 74 to pump outlet 75. At the other end of hose 74, a check valve 76 is preferably interposed in series with the conduit. The second internal air conduit comprises a tube 77 that connects the end of manifold section 52 to the bung 64 of storage tank 13. A rigid aluminum tube is suitable for the second conduit 77.

In most embodiments of the present invention, it is essential that the first conduit 74 constitute a flexible hose. When shroud assembly 12 is pivoted from the normal closed position of FIG. 2 to the open service position of FIG. 3, conduit 74 is subject to substantial distortion in most practical constructions. Thus, care must be taken to use a flexible conduit for this part of the portable compressor and also to provide sufficient length for the conduit so that it can remain effectively connected throughout the entire range of movement of shroud 12 between its normal and open positions, FIGS. 2 and 3 respectively.

A rigid conduit may be used for the first conduit 74, with a suitable pivotal connection in the conduit, if the pivot point is accurately aligned coaxial with the pivotal members 37 that secure shroud assembly 12 to base assembly 11. In most instances, however, this alignment is not practical or desirable.

The normal operation for compressor 10 remains unchanged from that afforded by conventional portable air compressors. Compressor pump 23, driven by its motor or other drive unit 24, supplies air under pressure to storage tank 13, pumping the air through a path comprising hose 74, check valve 76, manifold section 52, and conduit 77. Pump 23 remains in operation until a predetermined pressure is achieved in tank 13. When this is accomplished, the pressure sensor switch 60 acts automatically to de-energize motor 24. Whenever the tank pressure later falls below a given value, switch 60 acts to again energize motor 24, driving compressor pump 23 to recharge tank 13. At any time, compressed air can be withdrawn from tank 13 through regulator 53, outlet hose 55, and air chuck 56. A similar control arrangement can be provided for an internal combustion drive unit or for a clutch in a tractor PTO drive.

In normal operation of air compressor 10, shroud 12 is maintained in its closed position (FIG. 2). In this condition, pump 23 and drive unit 24 are totally enclosed by shroud 12 and tank 13, affording maximum safety for personnel working in the immediate area of the compressor. Personal injury from the projection of a hand or foot into the working mechanisms of the air compressor is precluded. Furthermore, the compressor mechanism is protected against damage from the intrusion of external objects.

On the other hand, whenever any service or maintenance procedure is necessary or desirable, complete access to pump 23 and drive unit 24 can be attained promptly and conveniently merely by releasing retainers 41 and lifting handle 42 to pivot shroud 12 to its open service position (FIG. 3). The entire operating mechanism is then readily accessible from all sides and from above, allowing convenient servicing. In compressor 10, in which the entire support structure, including base 14 and shroud 32–35, is fabricated from sheet metal. In part, this is made possible by the reinforcing V depression 15 in base 14, which materially strengthens the base. With the illustrated construction, in a typical one-half horsepower (8 gallon) air compressor, base member 14 (and saddle 22) can be fabricated from 13 gauge sheet steel, which is relatively inexpensive and is easily fabricated. Shroud panels 32, 35, if suitably hemmed at their bottom and side edges, can be made of sheet steel as light as 20 gauge. Nevertheless, the compressor structure provides adequate strength and rigidity despite the high vibration level typical of piston pump operation.

I claim:

1. A portable air compressor comprising:

a base assembly including a base, a pump and a pump drive unit mounted on the base, a pair of wheels supporting one end of the base, and a stand supporting the other end of the base;

a shroud assembly, including a four-panel shroud open at the top and at the bottom, pivotally mounted on one end of the base assembly for movement between a normal position, in which the shroud encloses the pump and the pump drive unit, and an open position, in which the pump and pump drive unit are fully exposed for service, from three sides and from above;

a tank mounted on and closing the top of the shroud;

and air conduit means connecting the outlet of the pump to the tank and maintaining that connection for all positions of the shroud.

2. A portable air compressor according to claim 1 in which the air conduit means comprises a flexible hose.

3. A portable air compressor according to claim 1 in which the shroud assembly further comprises a control manifold affording an output connection, and in which the air conduit means comprises a first conduit connecting the outlet of the pump to the control manifold and a second conduit connecting the manifold to the tank.

4. A portable air compressor according to claim 3 in which the first conduit comprises a flexible hose.

5. A portable air compressor according to claim 1, in which the base is a sheet metal base plate formed with a V-shaped reinforcement depression extending longitudinally thereof.

6. A portable air compressor according to claim 1, in which the pivotal mounting for the shroud comprises two pivot members secured to the base and extending through the lower portions of the side panels of the shroud at one end of the shroud and base assemblies, and further comprising releasable retainer means for anchoring the other end of the shroud to the base when the shroud is in its normal position.

* * * * *